United States Patent [19]

Zinsmeyer

[11] Patent Number: 4,938,664

[45] Date of Patent: Jul. 3, 1990

[54] OIL RECLAIM SYSTEM

[75] Inventor: Thomas M. Zinsmeyer, Pennellville, N.Y.

[73] Assignee: Carrier Corporation, Syracuse, N.Y.

[21] Appl. No.: 435,129

[22] Filed: Nov. 13, 1989

[51] Int. Cl.[5] ..... F04B 23/08

[52] U.S. Cl. ..... 417/83; 134/6.16

[58] Field of Search ..... 417/80, 82, 83, 78, 417/79, 151; 184/6.16; 415/168.1

[56] References Cited

U.S. PATENT DOCUMENTS

| | | | |
|---|---|---|---|
| 2,684,196 | 7/1954 | Wood | 417/83 |
| 2,941,474 | 6/1960 | Hall | 417/83 |
| 4,627,792 | 12/1986 | Jensen et al. | 417/83 |

FOREIGN PATENT DOCUMENTS

| | | | |
|---|---|---|---|
| 105560 | 7/1924 | Switzerland | 184/6.16 |
| 548589 | 10/1942 | United Kingdom | 184/6.16 |

*Primary Examiner*—Leonard E. Smith
*Assistant Examiner*—R. Blackmon
*Attorney, Agent, or Firm*—Dana F. Bigelow

[57] ABSTRACT

In a centrifugal compressor having an ejector for reclaiming the oil which tends to accumulate in a lower portion of the suction housing, the ejector high pressure line is provided with its inlet at the bottom of the collector such that, in addition to providing the high pressure power to the ejector, it also functions to pump out any oil that has accumulated at the bottom of the collector and to discharge it into the oil sump.

3 Claims, 1 Drawing Sheet

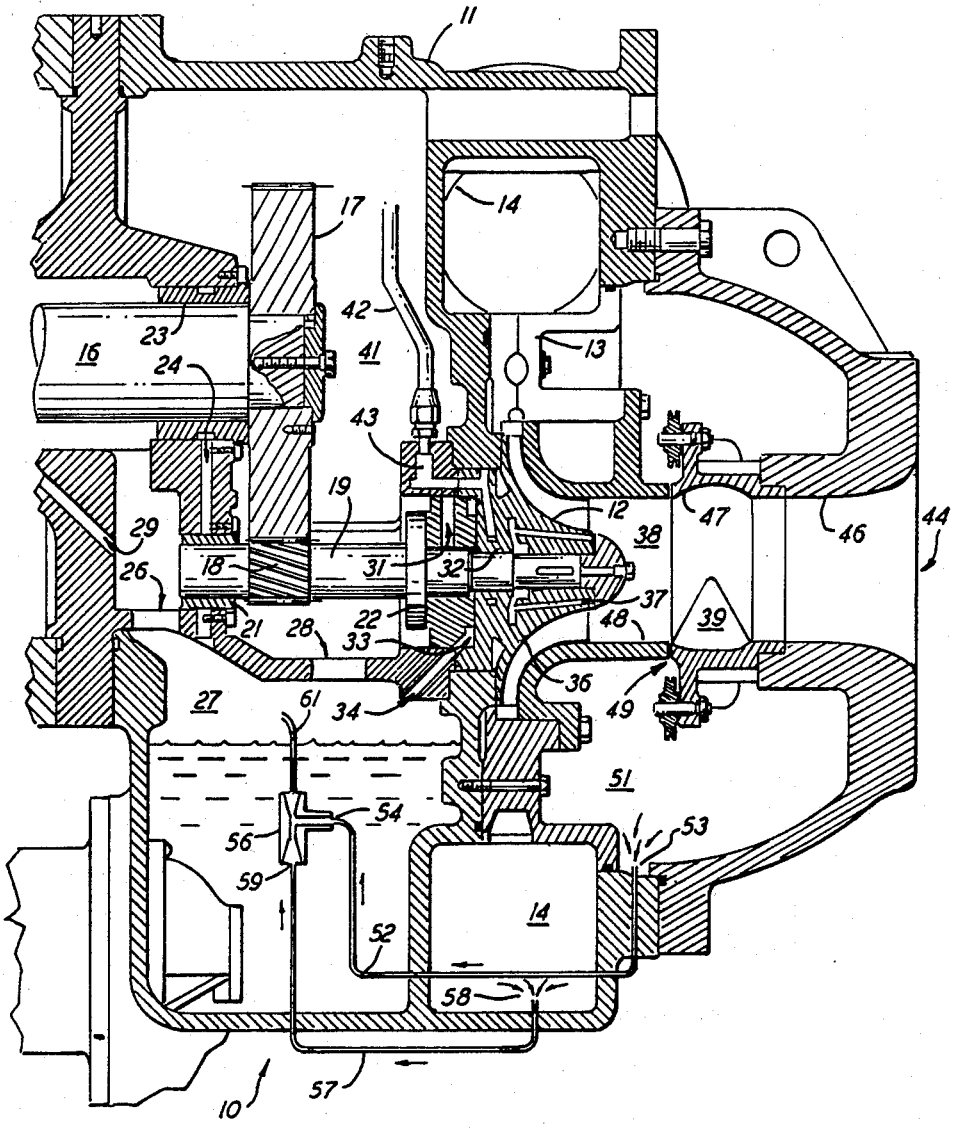
11
14
17
42
23
16
24
41
13
43
19
12
47
46
44
29
38
26
18
31
32
37
21
28
22
48
39
33
36
27
61
34
49
51
54
53
56
59
14
52
58
57
10

OIL RECLAIM SYSTEM

BACKGROUND OF THE INVENTION

This invention relates generally to centrifugal compressors and, more particularly, to a method and apparatus for reclaiming oil that accumulates in the bottom of a collector structure.

In centrifugal compressors of the type which are used in large chiller type air conditioning systems, there is an inherent tendency for oil to migrate from the transmission to other parts of the machine. It is therefore necessary in such systems to provide the capability of reclaiming this lost oil and returning it to the transmission so as to allow continuous operation of the machine and to avoid degradation of the heat exchanger performance brought on by oil contamination.

Typically, there is a need to extract oil from a stagnant area near the compressor inlet. An ejector is commonly used for this purpose, with the ejector being driven by high pressure discharge gas taken from the compressor discharge flange at the top portion of the volute. No attempt is made to reclaim the oil escaping into the aerodynamic portion of the compressor before it passes into the heat exchangers.

In a new centrifugal compressor design, the Applicant has found it attractive to use a collector in place of a volute in the area surrounding the impeller. In such a system, in addition to the problem of oil tending to collect near the inlet cavity as discussed hereinabove, there is also a problem with respect to the accumulation of oil in the collector. That is, whereas in the volute there are circumferential pressure gradients that cause gas to flow at velocities that are sufficient to propel the oil out of the volute, a collector exhibits circumferential pressure gradients to a much lesser extent and, as a result, oil tends to gather in the bottom of the collector. When this collection of oil becomes excessive, it will interfere with the proper flow of gas from the compressor.

It is therefore an object of the present invention to provide an improved oil reclaim system in a centrifugal compressor.

Another object of the present invention is the provision in a centrifugal compressor for reclaiming a portion of the oil that escapes into the aerodynamic portion of the compressor before it passes into the heat exchangers.

Yet another object of the present invention is the provision in a centrifugal compressor for the use of a collector structure rather than a volute.

Still another object of the present invention is the provision in a centrifugal compressor having a collector for avoiding the problem of oil buildup in the bottom of the collector.

Yet another object of the present invention is the provision in a centrifugal compressor for an oil reclaim system which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, the ejector that is used to scavenge the oil from the compressor inlet is driven by the high pressure gas that is taken from a location in the bottom of the collector. In this way, the high pressure gas performs the same function as did the high pressure gas from the top portion of the volute, but it also functions to automatically scavenge any oil that has tended to accumulate in the bottom of the collector. It therefore allows for the recovery of oil escaping from the transmission before it reaches the heat exchangers and thereby reduces oil contamination in the heat exchangers.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

FIG. 1 is a partial sectional view of a centrifugal compressor having the present invention incorporated therein.

DESCRIPTION OF PREFERRED EMBODIMENT

Referring now to FIG. 1, the invention is shown generally at 10 as installed in a centrifugal compressor 11 having an impeller 12 for accelerating refrigerant vapor to a high velocity, a diffuser 13 for decelerating the refrigerant to a low velocity while converting kinetic energy to pressure energy, and a collector 14 to collect the discharge vapor for subsequent flow to the condenser. Power to the impeller 12 is provided by an electric motor (not shown) which is hermetically sealed in the other end of the compressor and which operates to rotate the low speed shaft 16 which, in turn, is drivingly connected to a drive gear 17, a driven gear 18, and a high speed shaft 19.

The high speed shaft 19 is supported by the bearings 21 and 22 on either end thereof, with the bearing 22 acting as both a journal bearing to maintain the radial position of the shaft 19 and as a thrust bearing to maintain the axial position thereof.

The lubrication of those bearings occurs as follows. After lubrication of the low speed bearing 23, the oil flows downwardly through passage 24 to lubricate the bearing 21. The oil then runs from the left side of the bearing 21 through the opening 26 to enter the sump 27. Similarly, it flows from the right side of the bearing through the opening 28 into the sump 27. The opening 26 also accommodates the flow of oil from the passage 29, which in turn receives the oil from the other low speed shaft bearing (not shown).

Referring now to bearing 22 at the other end of the high speed shaft 19, an oil feed passage 31 is provided as a conduit for oil flowing radially inwardly to the bearing surfaces, and an oil slinger 32 is provided to sling the oil radially outwardly from the shaft 19. An annular cavity 33 then functions to receive the oil which is slung off from the bearing 22 and to facilitate the drainage of oil through a passage 34, back to the sump 27.

In order to provide a counteraction to the aerodynamic thrust that is developed by the impeller 12, a balance piston is provided by way of a low pressure cavity 36 behind the impeller wheel 12. A passage 37 is provided in the impeller 12 in order to maintain the pressure in the cavity 36 at the same low pressure as that in the compressor suction area indicated generally by the number 38. Since the pressure in the transmission casing 41 is higher than that in the cavity 36, and especially at part load operation, a labyrinth seal is provided between the bearing 22 and the impeller 12 to seal that area against the flow of oil from the transmission into the balance piston 36. This concept is well known as is the further concept of pressurizing the labyrinth seal by exerting high pressure gas thereon. The high pressure vapor for pressurizing the labyrinth seal is introduced by way of the line 42 and its associated passages indicated at 43.

Referring now to the manner in which the refrigerant flow occurs in the compressor 11, the refrigerant enters the inlet opening 44 of the suction housing 46 through the blade ring assembly 47 and the guidevanes 39, and then enters the compression suction area 38 which is defined on its outer side by the shroud 48. The refrigerant then flows into the impeller 12 where it is compressed.

As the refrigerant enters the compressor from the evaporator, it is primarily in the gaseous state; however, there are liquid droplets suspended therein that are formed from a combination of liquid refrigerant and oil. As they enter the suction housing 46 and pass through the blade ring assembly 47, those droplets tend to impinge on the side walls of those structures. In their axial movement along those side walls, the droplets eventually arrive at a gap 49 between the blade ring assembly 47 and the shroud 48.

The oil tends to adhere to the surface it is in contact with, and thus is unable to bridge the gap between the parts. Eventually oil builds up to the point where it begins to run down the gap and into cavity 51 in the lower part of the suction housing 46. Since any accumulation of oil in the cavity 51 acts to remove oil from the active lubrication system, it is important that this oil be removed from the cavity 51 and returned to the lubrication system. An ejector is commonly used for this purpose. However, the ejector system of the present invention is different from that of existing systems and operates to perform another important function as will be recognized by the description hereinafter.

Similar to existing systems, the suction or low pressure line 52 has its open end 53 disposed at the bottom of the cavity 51 so as to fluidly communicate between that point and the suction port 54 of the ejector 56. Unlike existing systems, the high pressure line 57 has its inlet end 58 located at the bottom of the collector 14 as shown and provides fluid communication to the high pressure suction port 59 of the ejector 56.

In operation, the high pressure refrigerant vapor in the collector 14 flows into the high pressure line 57 to power the ejector 56 which, in turn, draws a suction on the low pressure line 52 to pump the accumulated oil from the bottom of the cavity 51, to be discharged from discharge line 61 to the sump 27. Because of the structure and the operational characteristics of the collector of an operating centrifugal compressor, oil will tend to accumulate in the bottom portion of the collector. As the high pressure refrigerant enters the inlet end 58 of the high pressure line, it will allow any such accumulated oil to also flow into the high pressure line 57 and through the ejector 56 to be discharged along with the pump oil from the cavity 51, through the discharge line 61 and into the sump 27. In this way, the ejector 56 operates to both pump the oil from the cavity 51 and from the lower portion of the collector 14.

While the present invention has been disclosed with particular reference to a preferred embodiment, the concepts of this invention are readily adaptable to other embodiments, and those skilled in the art may vary the structure thereof without departing from the essential spirit of the present invention.

What is claimed is:

1. An improved oil ejector system of the type operable to scavenge oil from a lower portion of a centrifugal compressor inlet housing and deliver it to an oil sump comprising:

an ejector pump having a low pressure line fluidly connected to the inlet housing lower portion and a discharge nozzle fluidly connected to the oil sump, said ejector pump having a high pressure inlet which is supplied with a high pressure flow of fluid from a bottom portion of a collector containing high pressure refrigerant as well as an accumulation of lubricating oil therein.

2. An improved oil recovery system for a centrifugal compressor of the type which employs an ejector to pump accumulated oil from the compressor inlet to an oil sump with the use of high pressure gas from the compressor comprising:

a collector for collecting the compressed refrigerant after it leaves a diffuser portion of the compressor, said collector having a substantially symmetrical circumferential cross section and being susceptible to an accumulation of oil in its bottom portion; and a high pressure ejector line fluidly interconnecting said collector bottom portion to a high pressure inlet of the ejector to thereby simultaneously power the ejector and scavenge the accumulated oil from said collector bottom portion.

3. An improved method of driving an oil ejection system of the type which is operable to scavenge oil from the inlet of a centrifugal compressor, wherein the compressor has a collector which is susceptible to the accumulation of oil in its bottom portion and delivers it to an oil sump comprising the steps of:

providing a high pressure ejector line between the bottom portion of the collector and a high pressure inlet of the ejector and allowing the flow of high pressure fluid therein; and applying said high pressure flow to simultaneously drive the ejector and scavenge the accumulator oil from said collector bottom portion.

* * * * *